United States Patent [19]

Monticup, Jr. et al.

[11] Patent Number: 5,004,023

[45] Date of Patent: Apr. 2, 1991

[54] GASOLINE NOZZLE WITH EMERGENCY SHUT-OFF

[76] Inventors: Anthony Monticup, Jr., 3 Martin Ct., Clifton Park, N.Y. 12065; Franklin L. Gubernick, 1420 Nott St., Schenectady, N.Y. 12308

[21] Appl. No.: 494,127

[22] Filed: Mar. 30, 1990

[51] Int. Cl.[5] ..... B67D 5/373

[52] U.S. Cl. ..... 141/208; 141/392

[58] Field of Search ..... 141/206–211, 141/227–229, 392

[56] References Cited

U.S. PATENT DOCUMENTS

| | | | |
|---|---|---|---|
| 3,042,083 | 7/1962 | Kruckeberg | 141/215 X |
| 3,062,247 | 11/1962 | Botkin | 141/209 |
| 3,196,908 | 7/1965 | Billian | 141/209 |
| 3,474,837 | 10/1969 | Carder et al. | 141/392 |
| 3,513,887 | 5/1970 | Limandri | 141/207 |
| 3,548,893 | 12/1970 | Moore | 141/208 |
| 3,638,689 | 2/1972 | Eklund | 141/208 X |
| 3,646,974 | 3/1972 | Moore et al. | 141/392 |
| 3,823,752 | 7/1974 | Lasater et al. | 141/225 X |
| 4,121,635 | 10/1978 | Hansel | 141/208 X |
| 4,438,793 | 3/1984 | Brown | 141/382 |
| 4,556,093 | 12/1985 | Jones | 141/206 |
| 4,567,924 | 2/1986 | Brown | 141/207 |

*Primary Examiner*—Henry J. Recla
*Assistant Examiner*—Casey Jacyna
*Attorney, Agent, or Firm*—Schmeiser, Morelle & Watts

[57] ABSTRACT

A liquid dispensing nozzle that includes a break-away outlet portion and an emergency shut-off mechanism. The emergency shut-off is actuated by separation of the outlet portion from the body of the nozzle. The emergency shut-off includes a valve mechanism which, when closed, stops the flow of liquid.

9 Claims, 3 Drawing Sheets

GASOLINE NOZZLE WITH EMERGENCY SHUT-OFF

FIELD OF THE INVENTION

The invention is in the field of liquid dispensing nozzles. More particularly, the invention is in the field of dispensing nozzles that include apparatus for automatically stopping the flow of liquid in emergency situations.

BACKGROUND OF THE INVENTION

The invention pertains to liquid dispensing nozzles of the type used on gasoline pumps. A gasoline station often has two islands and each island will have from three to six gasoline pumps. These pumps consist of a fluid pump, fluid meter, hose and nozzle. The nozzle commonly includes a flow control valve and an automatic shut-off unit. The automatic shut-off unit senses when a tank that is receiving fuel is full and stops the fuel flow accordingly.

Service stations can be of the full serve type where an attendant operates the pump or of the self-serve type where the driver operates the pump to dispense fuel into his or her own vehicle. Most times, the fuel delivery system works flawlessly and the fuel transfer is made without spillage. However, there are rare instances when a significant fuel spillage can occur.

The most common cause of these incidents is the motor vehicle operator driving the vehicle away from the pump before the pump has been shut-off. This can be due to inattention on the driver's part, or the attendant being rushed and forgetting to remove the nozzle. Whatever the cause, the scenario involves the nozzle tip remaining in the car's fuel inlet as the vehicle drives off. As the fuel hose reaches its maximum extension, any of the following can occur: the pump can be pulled over, the hose can break or the nozzle tip can break off from the nozzle. Usually, the nozzle tip includes a weakened wall section so that the latter event is favored. This saves the majority of the pump equipment from being damaged, but a major spillage of gasoline can still result.

When the nozzle tip is separated from the nozzle body, the automatic shut-off is either disabled or not in an actuable orientation. Therefore, if the pump is on, gasoline will continue to flow from the nozzle and spill onto the ground. Liquid will not stop flowing until the attendant manually operates the shut-off valve. In some cases, a short but significant amount of time may pass before the attendant becomes aware of the situation. Even in a short period of time, in excess of a hundred gallons of fuel may discharge from the nozzle. Spilled gasoline in any amount can be an extreme fire hazard, and at a service station, a gasoline fire can be catastrophic.

Therefore, it is the objective of the invention to provide a mechanism which is low in cost and which will automatically stop the flow of fuel in the event that the nozzle tip is separated from the nozzle.

SUMMARY OF THE INVENTION

The invention is a mechanism that automatically stops the fuel flow once the nozzle tip has been separated from the nozzle body. Two different embodiments of the invention are disclosed. Both embodiments include one portion that senses the absence of the nozzle and another portion that acts to stop the flow of fuel.

The first embodiment uses a break away nut to attach the nozzle tip to the nozzle body. If undue pressure is exerted on the nozzle tip, the nut will break apart and the nozzle tip will be free to separate from the nozzle body. As the nozzle tip is removed, a spring loaded valve is caused to move to a closed position in which the flow of fuel is stopped.

The second embodiment makes use of the existing automatic shut-off mechanism. In this embodiment, the air inlet to the automatic shut-off is modified so that removal of the nozzle tip causes separation of the air inlet tube in a predetermined area. In this area, the tube is in two pieces and the pieces are joined by a connector. The ends of the two tube pieces are adapted so that when they separate at the connector, they will be immersed in the fluid flow. In this way, the flow of fuel from the nozzle will itself block the air inlet tube that is still connected to the nozzle and thereby actuate the automatic shut-off unit to stop the flow of fuel. The automatic shut-off uses a mechanism to release the manual valve handle at its pivot point and thereby allow the main fuel valve to close. Therefore this embodiment, by its use of the fuel to close the air inlet tube, emploYs a form of valving in the air inlet tube to initiate the emergency stoppage of fuel flow.

Both of the above embodiments modify the design of the basic fuel nozzle without significantly adding to its cost or complexity.

DETAILED DESCRIPTION OF THE DRAWINGS

Figure 1:
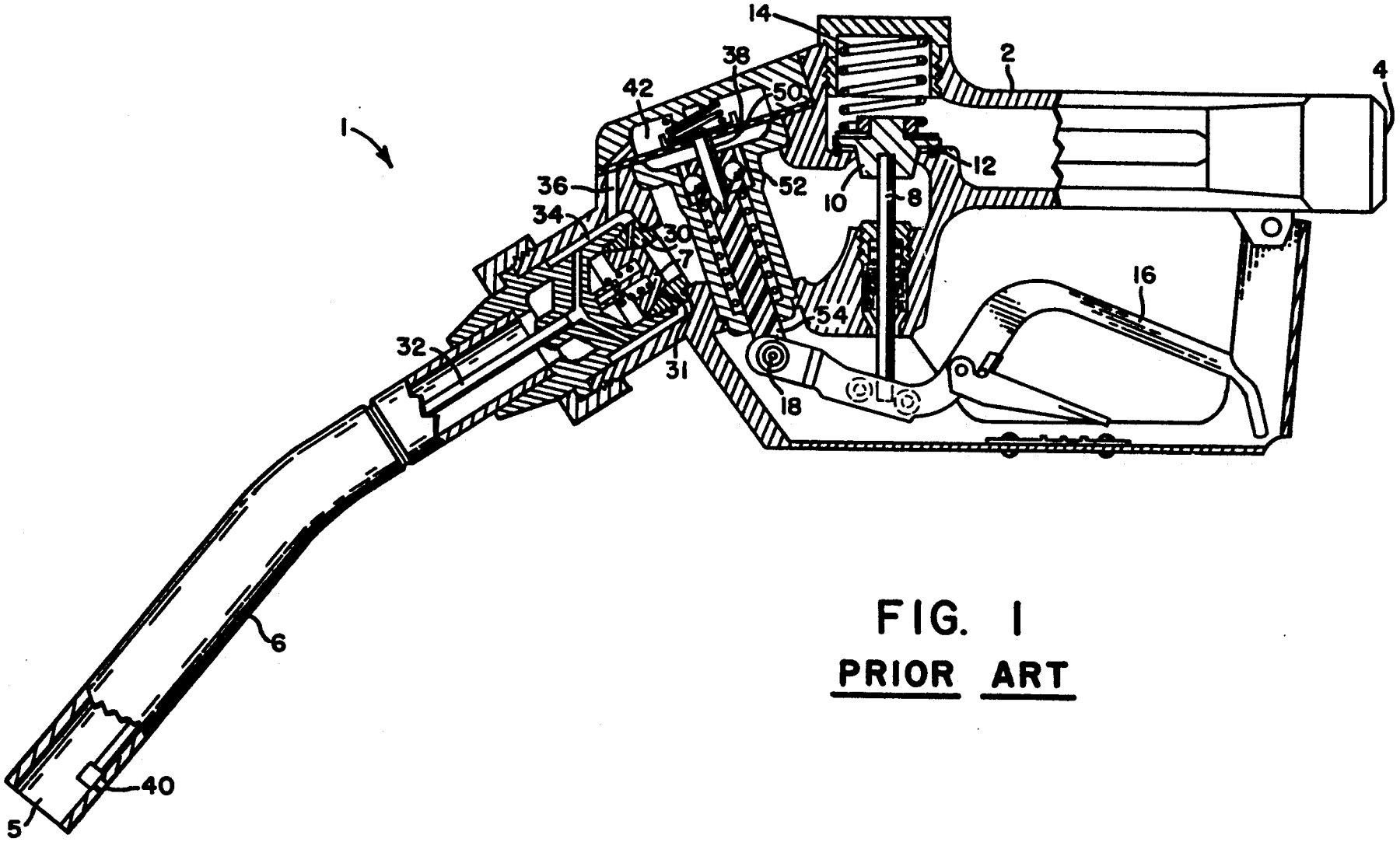
FIG. 1 PRIOR ART
FIG. 1 is an elevational view, partially in cross section of a prior art gasoline dispensing nozzle.

FIG. 1 is an elevational view of a prior art dispensing nozzle. Portions of the nozzle are shown in cross-section so that its inner working components may be seen.

The nozzle 1 includes a body 2, fluid inlet 4 and fluid outlet tube 6. Within the body there is an anti-drip valve 7 and a manually operated fluid control valve. The fluid control valve includes a stem 8, disc 10 and seat 12. The valve is biased toward a closed position by spring 14. To open the valve, a user would lift handle 16 which causes the handle to pivot about pivot point 18. This motion puts upward force on the valve stem which causes the valve to open. Once open, fluid can flow through the inlet 4, past the valve, and out the outlet 5. Once the handle is released, the spring 14 urges the disc towards the seat and thereby closes the valve and moves the handle 16 to the position shown in FIG. 1.

The nozzle shown includes an automatic shut-off mechanism which causes the fluid flow to stop when the fluid receiving tank is full. This mechanism comprises a venturi 30, air inlet tube 32, air chamber 34, vacuum tube 36 and diaphragm 38.

As the fluid is dispensed from the nozzle, the fluid flows through venturi 30. This flow of fluid past the venturi creates a vacuum which is passed to chamber 34 by passages 31. The chamber is connected by tube 32 to an exterior air inlet port 40 located in the fluid outlet tube. The vacuum in the chamber causes air to enter the port 40, flow through the inlet tube 32 and enter the chamber 34. From the chamber, the air passes through passages 31 and exits into the fluid stream near the outlet of the venturi.

Once the tank receiving fluid from the nozzle becomes full, splashing liquid covers the air inlet port 40 and blocks the flow of air passing to chamber 34. The vacuum in the chamber is then transmitted through vacuum tube 36 into chamber 42. Diaphragm 38 is located at the bottom of the chamber and beneath the diaphragm is ambient air. The pressure difference between the air above and below the diaphragm causes the diaphragm to lift upwards. As the diaphragm rises, an attached keeper 50 is lifted and ball bearings 52 are allowed to move inwards The ball bearings function to lock rod 54 in place. Once the ball bearings move inward, the rod 54 is allowed to move in a substantially vertical direction. At the bottom of the rod is the handle pivot 18. Unlocking of the rod 54 allows the handle 16 to move downward under the force of spring 14. As the handle moves downward, the flow control valve (8,10,12) is closed and fluid flow into the tank stops Therefore, blocking of the air inlet port by splashed fuel causes an almost instantaneous release of rod 54 and subsequent closing of the flow control valve.

Figures 2A, 2B:
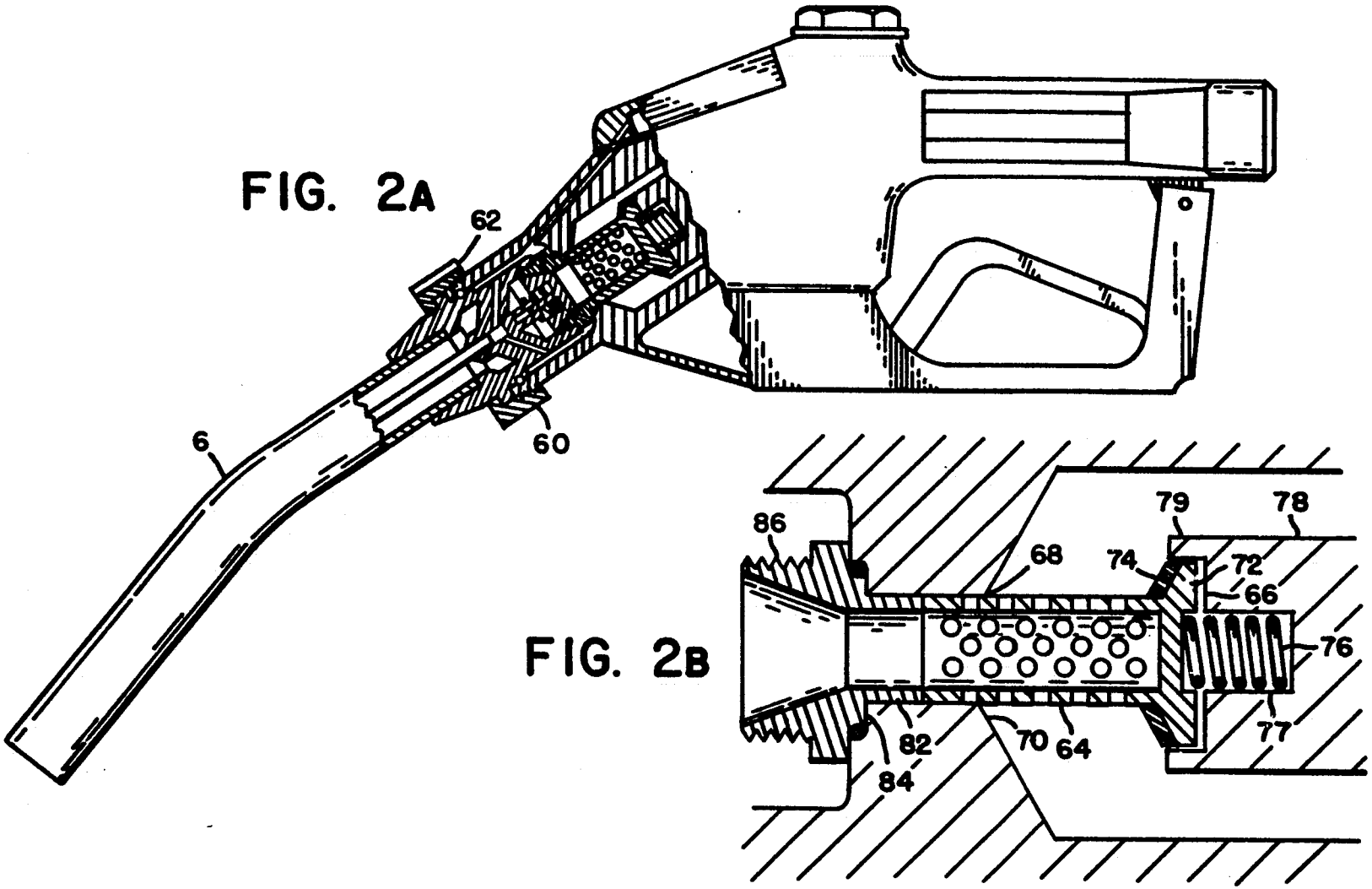
FIG. 2A is an elevational view of the forward portion of a nozzle incorporating the first embodiment of the invention.
FIG. 2B is a detailed view of the valve arrangement shown in FIG. 2A.

FIG. 2A shows a first embodiment of an emergency shutoff mechanism. The fluid outlet tube 6 is fastened to the nozzle body by a break-away nut 60. This nut has a reduced wall thickness portion 62 that decreases the strength of the fastener. If a force greater than a predetermined amount is applied to the tube 6, the nut 60 will break. The force required to break the nut would be applied as the car drives away from the pump with the outlet tube 6 still located in the car's fuel inlet. The predetermined force would be greater than the forces normally experienced by the nozzle during insertion of the outlet tube 6 into a car's fuel inlet. The predetermined force would also be greater than the force applied during an inadvertent droppage of the nozzle onto the ground.

The emergency shut-off mechanism also includes a second fluid control valve located within the nozzle body. A detailed view of the valve is provided in FIG. 2B. The valve is a spool-type valve and comprises a cylindrical apertured cylinder 64 having a solid end 66 which forms the valve disc. The cylinder is supported within a cylindrical chamber 68 in the nozzle body. The rearward end of the chamber includes a valve seat 70. The valve disc or cylinder end 66 includes a circular flange portion 72 which extends radially outward from the cylinder Walls. A forward portion of the flange includes a ring of fuel resistant plastic sealing material 74. The valve is spring biased toward a closed position by spring 76 which is received within a cavity 77. The cavity is located within foundation 78 that is connected to an inner wall of the nozzle body. The foundation includes a forward ring shaped lip 79 which secures and supports the rear portion of the valve cylinder when the valve is located as shown.

Adjacent the side of the valve cylinder is an access port (not shown) through which the cylinder and spring may be removed. The cylinder 64 is maintained in its rearward position by rearwardly extending projections 82 located on the rearward face 84 of the venturi. It should be noted that the venturi is connected by threads 86 to the fluid outlet tube 6 and is not fastened to the nozzle body.

In operation, when a force greater than a predetermined amount acts on the fluid inlet tube 6, the nut 60 breaks and the tube is pulled from the nozzle body. Since the venturi is connected to the tube, it also is pulled form the body. As the venturi moves forward, its rear projections move forward. At this point, the cylinder moves forward due to its spring biasing. The cylinder's forward movement is halted once the outer flange 72 of its disc portion contacts the valve seat 70. The disc, acted on by both the spring force and force of the contained fluid within the nozzle body, completely halts the flow of liquid. The plastic sealing ring 74 ensures a leak-free seal. Fluid flow can be resumed once a new outlet tube with venturi is attached to the nozzle body.

Figures 3A, 3B:
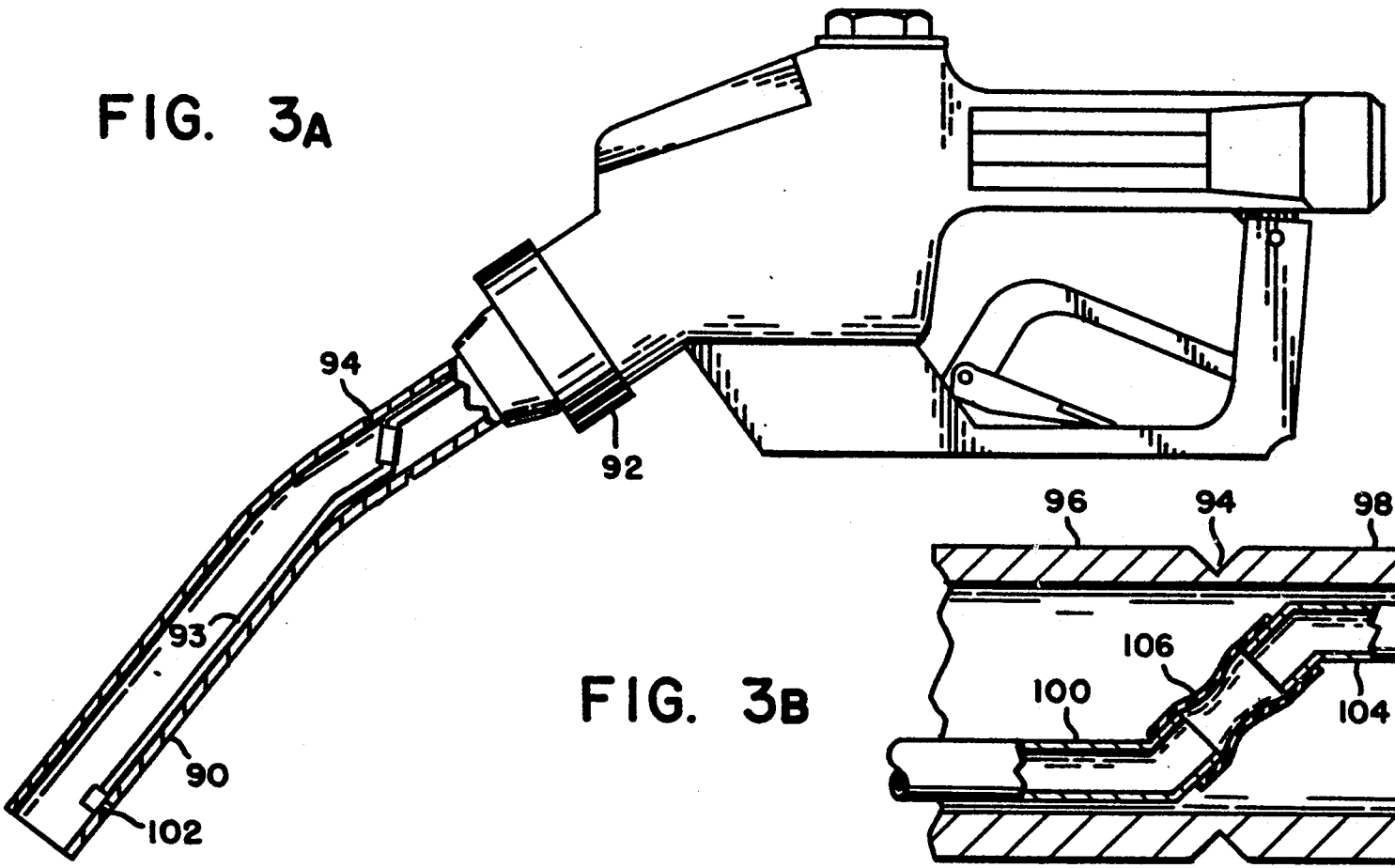
FIG. 3A is an elevational view of the forward portion of a nozzle incorporating the second embodiment of the invention.
FIG. 3B is a detailed view of the nozzle tip in the area of the weakened wall portion.

FIG. 3A shows a second embodiment of an emergency shut-off system. In this embodiment, a standard nozzle body and automatic fuel shut-off system is used. However, a modified fuel outlet tube 90 is employed. The outlet tube is fastened to the nozzle body by a standard nut 92. An air inlet tube 93 is located within the fuel outlet tube for actuating the automatic fuel shut-off system as previously described.

In this embodiment, the fuel outlet tube includes a weakened wall portion located near the end of the tube adjacent the nut 92. As shown, a groove 94 has been cut in the wall to decrease the wall's thickness and strength. A detailed view of the outlet tube in the region of the groove is provided in FIG. 3A. The groove is sized whereby the usual forces applied to the nozzle will not cause the outlet tube to separate at groove 94. However, forces of larger magnitude will cause the forward portion 96 of the outlet tube to separate from the rearward portion 98. Internal to portion 94, the air inlet tube is modified to separate in a predetermined manner should the liquid outlet tube be caused to separate.

The air inlet tube includes a forward portion 100 rigidly connected to the air inlet port 102. The tube also includes a rearward portion 104. The rearward portion is rigidly connected to the rear portion 98 of the fuel outlet tube. Joining the two air tube portions is a connector 106. In the area of the connector, each of air inlet tube portions includes a forty-five degree bend. The connector is preferably of a fuel resistant plastic material and is in the form of a tube whose inner diameter is less than the outer diameter of the air inlet tube portions. Each of the air inlet tube portions is inserted into the connector and thereby causes the connector to slightly bulge in the areas that surround the tubes. The interference fit between the tubes and the connector maintains the connector in position during ordinary usage. However, should the forward end of the fuel outlet tube separate from the nozzle, one or the other of the tubes will separate from the connector since the forward air inlet tube is rigidly connected to the forward portion of the fuel outlet tube. This will then expose the inlet of the rearward air tube to the flowing liquid (due to the angled tube configuration) and thereby block the flow of air through the tube. This will cause actuation of the automatic shut-off system.

In operation, when a car drives away from a fuel pump with the nozzle still in the fuel tank inlet, the forward portion 86 of the fuel outlet tube will snap off from the nozzle. The nozzle body and rear portion of the fuel outlet pipe then fall to the ground. As the fuel outlet tube became separated, the forward portion 100 of the air inlet tube also separated from the rear air inlet tube portion 104. The rear portion of the air inlet tube and possiblY also the connector 106 will still be attached to the nozzle body. Since the portion of the air inlet tube still attached to the nozzle is angled relative to the flow of liquid through the rear portion of the fuel outlet tube, the liquid will block the open end of the remaining air inlet tube. This actuates the automatic shut-off mechanism to stop the flow of liquid.

It should be noted that even though the two embodiments of the emergency shut-off mechanism employ different components, they share broad concepts. Both embodiments include sensing mechanisms which can detect when at least a portion of the fuel outlet tube separates from the nozzle body. Once separation of the tube is detected, a valve means is actuated to cause the stoppage of fluid flow. In the second embodiment, the air inlet tube is considered a valve that is normally open When fluid blocks the tube, it is equivalent to a valve being in the closed position since air can no longer travel through the tube.

The embodiments disclosed herein have been discussed for the purpose of familiarizing the reader with the novel aspects of the invention Although preferred embodiments of the invention have been shown and described, many changes, modifications and substitutions may be made by one having ordinary skill in the art without necessarily departing from the spirit and scope of the invention.

I claim:

1. An improved liquid dispensing nozzle of the type having a liquid inlet, a nozzle body having a manually operated liquid control valve and a liquid outlet, wherein the improvement comprises:

an emergency shut-off means operatively connected to the nozzle and including means for stopping the flow of liquid should the liquid outlet be separated from the nozzle body;

an automatic shut-off means operatively connected to the nozzle which functions to stop liquid flow once a container that is receiving liquid from the nozzle outlet becomes full; and wherein the automatic shut-off means includes a venturi means and wherein the emergency shut-off means includes a valve means biased towards a closed position and wherein the venturi means includes means for maintaining said valve means in an open position that allows liquid flow whereby separation of said liquid outlet from said nozzle body causes the venturi means to at least partially move away from a centerpoint of said nozzle body and thereby allow the valve means to move to a closed position which stops the flow of liquid.

2. The nozzle of claim 1 wherein the emergency shut-off means comprises a second valve located within the nozzle body, said second valve having a first position whereby liquid can flow to the liquid outlet and a second position whereby the valve stops the flow of liquid in the direction of the outlet and wherein separation of the liquid outlet from the nozzle body causes the valve to assume its second position.

3. The nozzle of claim 1 wherein the liquid outlet is attached to the nozzle body by fastening means, said fastening means including means for allowing the rapid disengagement of said liquid outlet from said nozzle body if a force greater than a predetermined amount is applied to the liquid outlet

4. The nozzle of claim 3 wherein the means for rapid disengagement includes a frangible retaining nut.

5. The nozzle of claim 4 wherein said frangible nut includes a reduced thickness wall portion.

6. The nozzle of claim 1 wherein said valve means includes a spring loaded disc which is continually urged towards a seat and wherein the venturi means includes at least one projection which is operatively engaged to said disc.

7. The nozzle of claim 10 wherein said disc includes an apertured body through which liquid can flow when said valve means is in an open position.

8. A fluid nozzle comprising:

a nozzle body;

a fluid inlet located on one end of said nozzle body;

a fluid outlet located on another end of said nozzle body, said outlet being removably connected to said nozzle body;

a manually operated fluid control valve located in said body for controlling the flow of fluid from the fluid inlet to the fluid outlet; and an emergency fluid flow shut-off means operatively connected to said nozzle body capable of stopping the flow of fluid through the nozzle if the fluid outlet becomes disengaged from the nozzle body;

an automatic shut-off means which automatically causes the manually operated flow control valve to move to a closed position when a container receiving fluid from the fluid outlet becomes full; and wherein the automatic shut-off means includes a venturi means and wherein the emergency shut-off means includes a valve means biased towards a closed position and wherein the venturi means includes means for maintaining said valve means in an open position that allows liquid flow whereby separation of said liquid outlet from said nozzle body causes the venturi means to at least partially move away from a centerpoint of said nozzle body and thereby allow the valve means to move to a closed position which stops the flow of liquid.

9. The nozzle of claim 8 wherein the fluid outlet is connected to the nozzle body by a fastener which can be easily broken by an amount of force applied to the fluid outlet that is greater than a predetermined amount.

* * * * *